US007019498B2

(12) United States Patent
Pippin et al.

(10) Patent No.: US 7,019,498 B2
(45) Date of Patent: Mar. 28, 2006

(54) POWER FACTOR CORRECTION CIRCUIT

(76) Inventors: William Pippin, 11919 East Colonial Dr., #301, Orlando, FL (US) 32826; Nicholas D. Pilleggi, 208 Lochberry Pl., Longwood, FL (US) 32779

( * ) Notice: Subject to any disclaimer, the term of this patent is extended or adjusted under 35 U.S.C. 154(b) by 66 days.

(21) Appl. No.: 10/786,854

(22) Filed: Feb. 24, 2004

(65) Prior Publication Data

US 2005/0184708 A1 Aug. 25, 2005

(51) Int. Cl.
*G05F 1/455* (2006.01)

(52) U.S. Cl. ..... 323/239; 323/300

(58) Field of Classification Search ..... 323/234, 323/237–246, 299, 300
See application file for complete search history.

(56) References Cited

U.S. PATENT DOCUMENTS 4,851,635 A * 7/1989 Farrow ..... 219/110

* cited by examiner

*Primary Examiner*—Gary L Laxton
(74) *Attorney, Agent, or Firm*—Terry M. Sanks, Esquire; Beusse Wolter Sanks Mora & Maire, P.A.

(57) ABSTRACT

A method of power factor control for a power regulation system connected for supplying electric power to a reactive load, the power factor being characterized by a phase difference between a voltage waveform and an induced current waveform, the method comprising the steps of identifying a peak of an AC current waveform and a peak of an AC voltage peak waveform, determining a time delay between a designated peak of a half cycle of the voltage waveform and a peak of a corresponding half cycle of the current waveform; and adjusting the voltage applied to the load in a manner to vary the time delay so as to bring the power factor towards unity.

10 Claims, 5 Drawing Sheets

POWER FACTOR CORRECTION CIRCUIT

BACKGROUND OF THE INVENTION

The present invention relates to power factor control circuits for alternating current reactive loads and, more particularly, to a low cost power factor control circuit for AC induction motors.

Power factor control circuits are well known in the art and are used to improve efficiency of AC motor drives. In particular, AC induction motors generally operate at a speed which is related to the frequency of the applied excitation and independent, within limits, of the applied voltage and load. Accordingly, under light load conditions, the motor can run at constant speed but draw more current than is actually required to produce power to drive the light load. The motor is, therefore, inefficient at light load and power factor deteriorates. The practical solution to improve efficiency, i.e., power factor, is to adjust the voltage applied to the motor so that the applied voltage is a function of loading. Most AC motor power factor control circuits achieve this function by modulation of the voltage applied to the motor, i.e., by removing voltage from the motor for at least some portion of each half-cycle of the AC voltage waveform.

In general, circuits used with AC motors for power factor control employ some form of controllable electronic switching device, such as a triac, connected in series circuit between an AC power source and each phase winding of the motor. Monitoring circuit units (MCU) are then used to determine the zero crossings of the motor current and motor voltage, the difference between the zero crossings of voltage and current representing the phase shift, which is proportional to power factor. A microcontroller uses the phase shift measurement to adjust or control the triac conduction times so as to vary the duty cycle of the voltage applied to the motor in a manner to reduce the phase shift and thus improve motor efficiency.

A disadvantage of the prior art circuits for power factor control is the necessity of identifying the zero crossings of voltage and current. In many instances the current in the AC motor is characterized by noise and other oscillations which may create multiple zero crossings each time current reverses. Such current variations are reflected onto the voltage waveform and can provide similar difficulty in identifying a true zero crossing. As a consequence, circuits for determining current and voltage zero crossings may be more complex than desired and increase the cost of implementing power factor controls.

SUMMARY OF THE INVENTION

The present invention is illustrated in a method of power factor control for a power regulation system connected for supplying electric power to a reactive load. The system includes a microcomputer for supplying gating signals to an electronic switching device such as a triac for controlling the conduction phase angle of the triac to control the application of alternating current (AC) electric power to the load. The method comprises monitoring of the waveform of the AC voltage applied to the load and determining for each of the half-cycles of the waveform a timed event when the absolute value of the magnitude of the waveform transitions through a reference magnitude.

A mid-point between each pair of the timed events is designated as a peak of the voltage waveform. The process is repeated for the AC current waveform and the corresponding peaks of the current waveform identified. The time delay between a designated peak of the voltage waveform and a designated peak of a corresponding half-cycle of the current waveform is representative of the power factor of power supplied to the load and the applied voltage is adjusted in a manner to bring the power factor towards unity, i.e., by reducing the measured time delay. The system also monitors peak values of the AC current and limits the power factor adjustment to prevent peak current values from falling below a selected minimum value so as to prevent motor stall or overheat. Typically, the adjusting process removes voltage from the load for a portion of each half-cycle of the AC voltage waveform either by gating the triac out of conduction at beginning or end of a half-cycle or by pulse width modulation.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
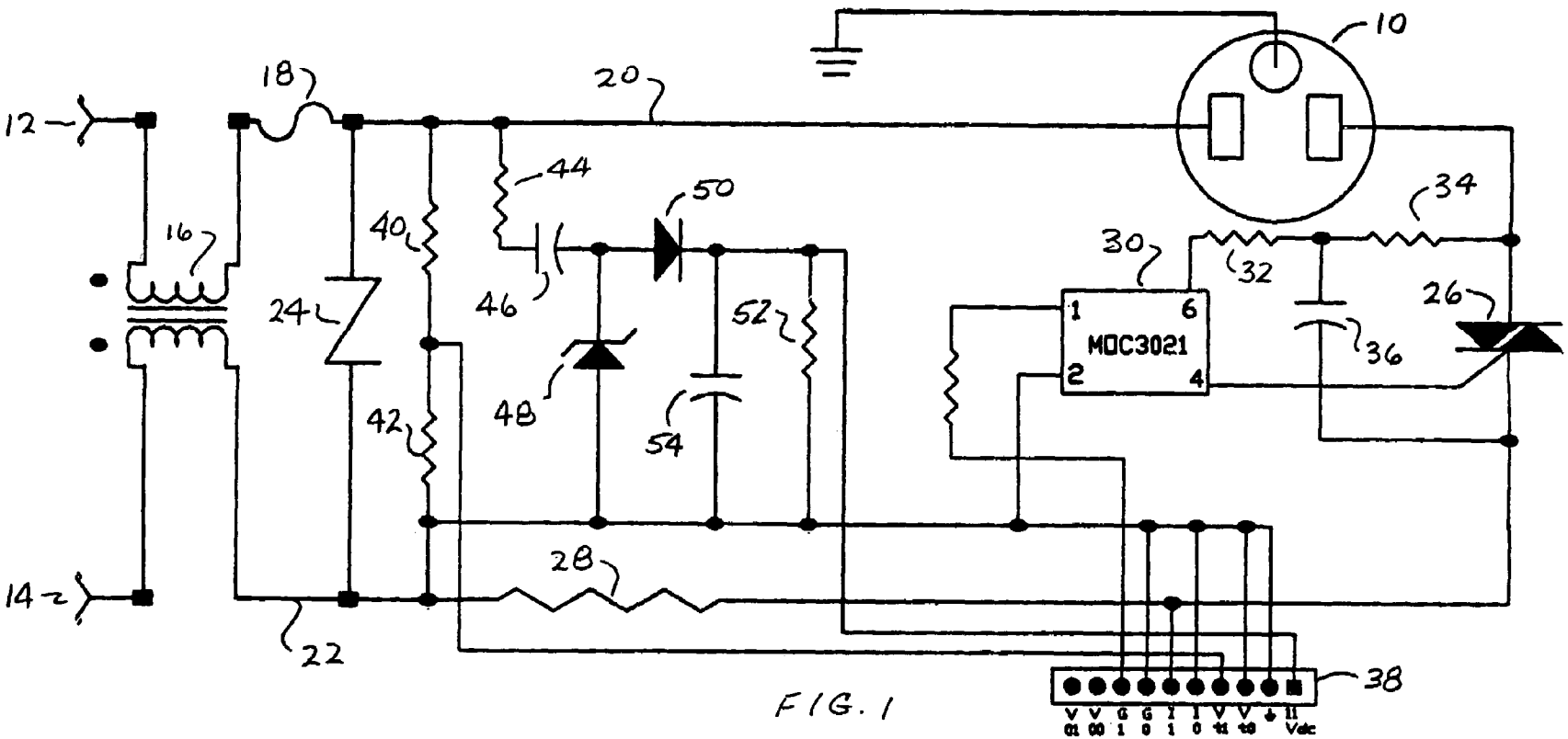
FIG. 1 is a schematic representation of a power control circuit incorporating some of the teachings of the present invention.

FIG. 1 is a schematic representation of an alternating current (AC) power control circuit for supplying power to an AC load 10 which may be, for example, an AC induction motor. While the invention will be described in terms of a single-phase load 10, it will be apparent that the invention is equally applicable to multi-phase applications such as, for example, a three-phase AC motor. In the circuit of FIG. 1, AC power from an external AC source such as an AC utility power connection is applied to terminals 12 and 14 and coupled through a toroidal coil inductor 16 and series fuse 18 to a pair of AC power buses 20, 22. An over voltage protection device such as a metal oxide varistor (MOV) 24 is connected between the buses 20 and 22. The bus 20 is connected to the first terminal of the load 10 while the bus 22 is connected to a second terminal load 10 through a series electronic switching device such as a triac 26. The circuit also includes a current sensing resistor 28 connected in series with triac 26 in AC bus 22. As will be apparent, power is coupled to the motor 10 by gating the triac 26 into conduction thereby connecting the motor directly between the bus 20 and bus 22. Gating signals coupled through an optical isolator 30 controls the triac 26. The optical isolator 30 is a conventional isolator such as an MOC 3021 and serves to isolate the utility power circuit from the low voltage control electronics. One output terminal of the optical isolator 30 is coupled to the gate terminal of the triac 26 and the other terminal is connected to the load side of the triac 26 through a pair of serial resistors 32 and 34. A capacitor 36 is connected from a junction intermediate the resistors 32 and 34 to the opposite side of the triac 26. The combination of the capacitor 36 and resistor 34 forms a snubber circuit to eliminate transient noises produced by undercurrent or under load switching of the triac 26. The gating signals to the optical isolator 30 are supplied from the control logic circuitry illustrated in FIG. 2 through the connector 38. The power control circuit also includes a pair of serially connected resistors 40, 42 connected between the busses 20, 22 and forming a voltage divider to provide a voltage signal proportional to the AC load voltage applied to load 10. This load voltage signal is coupled through the connector 38 to the circuit of FIG. 2.

Figure 2:
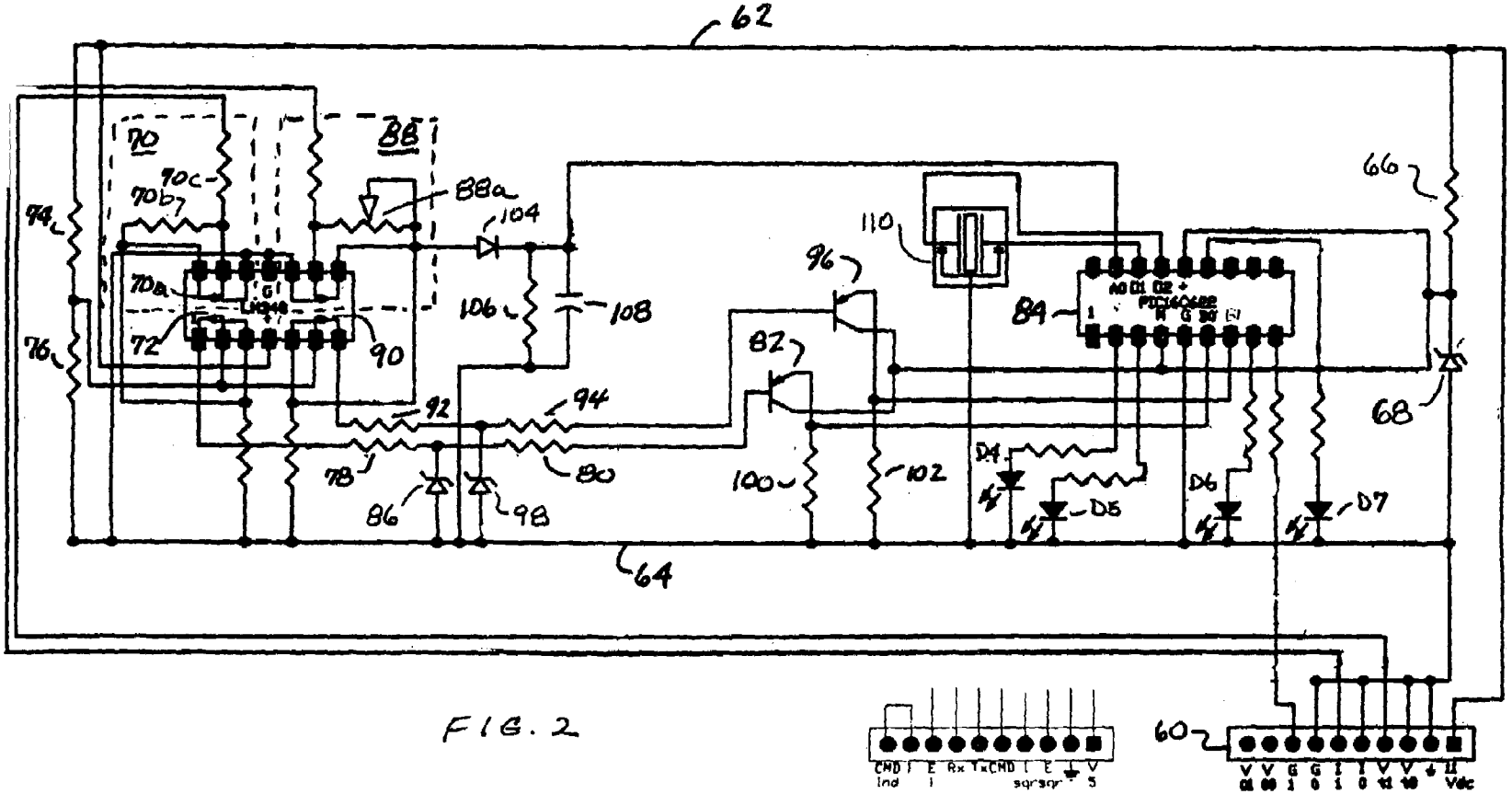
FIG. 2 is a schematic representation of a power factor detection and control circuit for use with the circuit of FIG. 1.

The power control circuit of FIG. 1 also includes a DC voltage supply for producing a DC voltage for powering the logic circuits in the circuit of FIG. 2. The DC voltage supply comprises the serial combination of a resistor 44, capacitor 46, and zener diode 48 connected between the AC buses 20 and 22. The zener diode 48 controls the value of the DC output voltage which is taken from its cathode junction through series diode 50. An output filter comprising a parallel combination of resistor 52 and capacitor 54 is connected between the cathode terminal of diode 50 and the DC bus 22, with the DC output voltage being taken at the cathode junction of the diode 50. The DC voltage is coupled to the circuit of FIG. 2 through the terminal connector 38. Turning now to FIG. 2, the logic control circuit for the power circuit of FIG. 1 utilizes voltage and current representative signals obtained from the circuit of FIG. 1 through the terminal connector 38. In particular, the terminals VTI and VTO of connector 38 provide signals representative of load voltage which are connected to corresponding terminals VTI and VTO of connector 60 in FIG. 2. Similarly, terminals 11 and 10 of connector 38 provide signals developed across the current sense resistor 28 representative of current in load and are connected to terminals Ii and 10 of connector 60. It will also be noted that the terminals G1 and GO of connector 38 connect to terminals GI and GO of connector 60 and are the terminals for passing gating signals from the logic control circuit of FIG. 2 to the power control circuit of FIG. 1. Additionally, the DC output voltage developed at the cathode terminal of diode 50 is coupled through the terminal VDC of connector 38 to the terminal VDC of connector 60 for supplying DC power to the logic control circuit.

In FIG. 2, the DC voltage is applied to a positive DC bus 62 and a negative DC or ground bus 64. In this particular embodiment, the voltage VDC developed in the circuit of FIG. 1 is higher than is actually needed to operate some of the logic circuits and devices of FIG. 2 and its voltage is reduced to a lower level by a regulator circuit including the series combination of a resistor 66 and a zener diode 68. The voltage representative signal from terminals VT1, VTO is coupled initially to a unity gain buffer amplifier 70 comprising an operational amplifier (op amp) 70*a* and a pair of gain setting resistors 70*b* and 70*c*. The output of the buffer amplifier 70 is coupled to a first input terminal of a comparator 72. A second input of the comparator 72 is connected to receive a voltage reference signal developed at the midpoint of a voltage divider comprising the resistors 74 and 76 serially connected between the DC buses 62 and 64. For purposes of this invention, the value of the voltage developed at the junction intermediate the resistor 74 and 76 is selected to be sufficiently high to assure good switching. More particularly, in order to reduce the cost of the voltage and current monitoring circuit, a type LM348 quad op amp is used, which op amp has relatively poor switching characteristics for voltages of less than about 4 volts. Accordingly, the reference voltage is selected to be at least about 5.5 volts in order to assure proper switching. When the AC voltage applied to the first input terminal of the op amp 72 exceeds the reference voltage, the op amp switches state and outputs a logic signal, i.e., either a ±5 volt for logic 1 or logic 0, which is coupled through the resistors 78 and 80 to a base terminal of a transistor 82. The logic signal is effective to change the state of the transistor 82 and to thereby apply a signal via its emitter terminal to an input terminal of a microprocessor 84. When the voltage falls below the reference voltage, the op amp 72 will again change states and apply another logic signal to the transistor 84 to change the state of the signal applied to the microprocessor. A zener diode 86 connected between the DC bus 64 and a junction intermediate the resistors 78 and 80 provide protection from transient voltages for the transistor 82.

A substantially identical circuit comprising the operational amplifier 88 and comparator 90 are used to monitor the current proportional voltage developed across the sensing resistor 28. The op amp 88 differs only in using a feedback resistor 88*a* which can be adjusted to set the gain of the amplifier 88. The signal produced by the amplifier 88 is compared in the comparator 90 with the same reference signal as was used with the comparator 72. The output of the comparator 90 is a logic signal which is coupled through the series resistors 92 and 94 to a base terminal of a switching transistor 96. The zener diode 98 protects the transistor 96 from transient voltages. The output of the transistor 96 is taken from its emitter terminal and coupled to an input terminal of the microprocessor 84. As indicated, each of the transistor switches 82 and 96 include emitter resistors 100 and 102, respectively, across which the output signals are developed.

The output signal developed by the op amp 88 is applied to a peak circuit comprising a diode 104 which supplies rectified half-wave pulses to an integrator comprising the combination of a resistor 106 and parallel capacitor 108. The peak circuit determines a positive peak value and a negative peak value of the current signal and supplies a signal representative of the current peak values to the microprocessor 84. It will also be noted that the processor 84 includes an external clock pulse generator or crystal oscillator 110 preferably operating at about 20 megahertz.

The processor 84 may be a conventional microprocessor such as a PIC 16C622 manufactured by Microchip Corporation. The processor senses the state change signals (logic signals) provided from the emitters of the transistors 82 and 96 and computes for each of the signals the time between successive signals. Using that information, the processor then determines the mid-point between the two signals which corresponds to a peak value of the voltage or current waveform and compares the midpoints to determine the time delay between the voltage and current waveforms.

Figure 3:
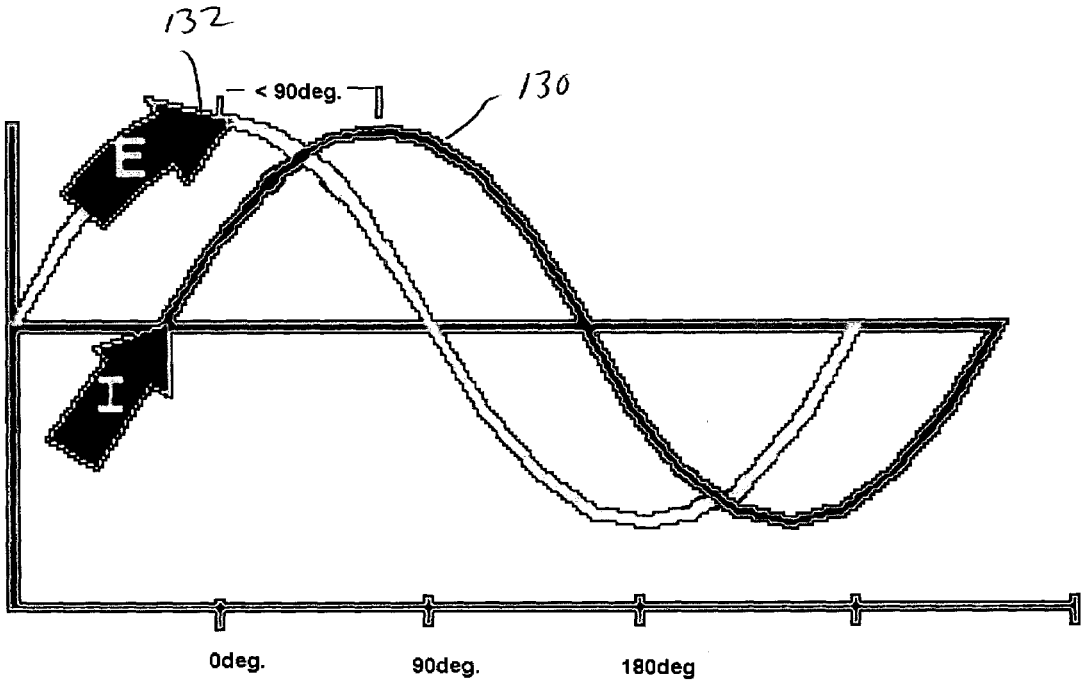
FIG. 3 is a graph of voltage and current waveforms useful in explaining the operation of the circuits of FIGS. 1 and 2.

Ideally a voltage waveform and current waveform are in phase. To better explain the operation of the microprocessor 84, reference is made to FIG. 3 which illustrates a voltage waveform 130 and current waveform 132 out of phase. When an inductor is added to a circuit, a shift occurs between real power and apparent power, where the larger the inductor the further the current, I, is apart from the voltage, E. Those skilled in the art will recognize that the present invention is not limited to loads that are purely inductive. As further illustrated in FIG. 3, in this exemplary illustration, the current and voltage waveforms are 90 degrees apart. Since an amount of current needed to power a device cannot be adjusted, the present invention reduces the average voltage underneath the curve illustrated in FIG. 3, with the switching circuit or triac, to result in the current and voltage waves being closer to zero degrees apart.

The MCU, or processor, adjusts the timing of the triac operation on both the positive and negative half-cycles of the voltage waveform. In particular, once the processor has computed the time difference between the peaks of the voltage and current waveforms, the processor outputs gating signals through resistor 106 to the terminal G1 of connector 60 and from there to the gate of the triac 26 via the optical isolator 30. In one preferred embodiment, the time difference is computed by monitoring of the waveform of the AC voltage applied to the load and determining for each of the half-cycles of the waveform a pair of timed events when the absolute value of the magnitude of the waveform transitions through a reference magnitude. A mid-point between each pair of the timed events is designated as a peak of the voltage waveform. The process is repeated for the AC current waveform and the corresponding peaks of the current waveform identified. The time delay between a designated peak of the voltage waveform and a designated peak of a corresponding half-cycle of the current waveform is representative of the power factor of power supplied to the load and the applied voltage is adjusted in a manner to bring the power factor towards unity, i.e., by reducing the measured time delay.

In another preferred embodiment, the magnitudes of the waveforms are estimated. Though applying an integration equation to determine the maximum point of area under the curve is the most accurate method, estimating is a more reliable approach when a non-uniform waveform is created. In such a waveform, the zero crossing is typically not uniform. Additionally, the current waveform is also not uniform when the positive peaks and the negative peaks are not equally spaced. As disclosed, a power factor determinant is calculated by comparing the positive peak and the negative peak to estimate the center of maximum area under a curve, or waveform. The resulting information is used to determine when to chop the voltage to bring the voltage waveform as close as possible to in-phase with the current waveform.

In addition to being more cost effective, estimation may be used since the voltage and current waveforms may not cross the zero crossing, which only usually occurs in ideal situations. With estimation, a truer power factor value based on the area under the current and voltage curves may still be determined.

Figure 4:
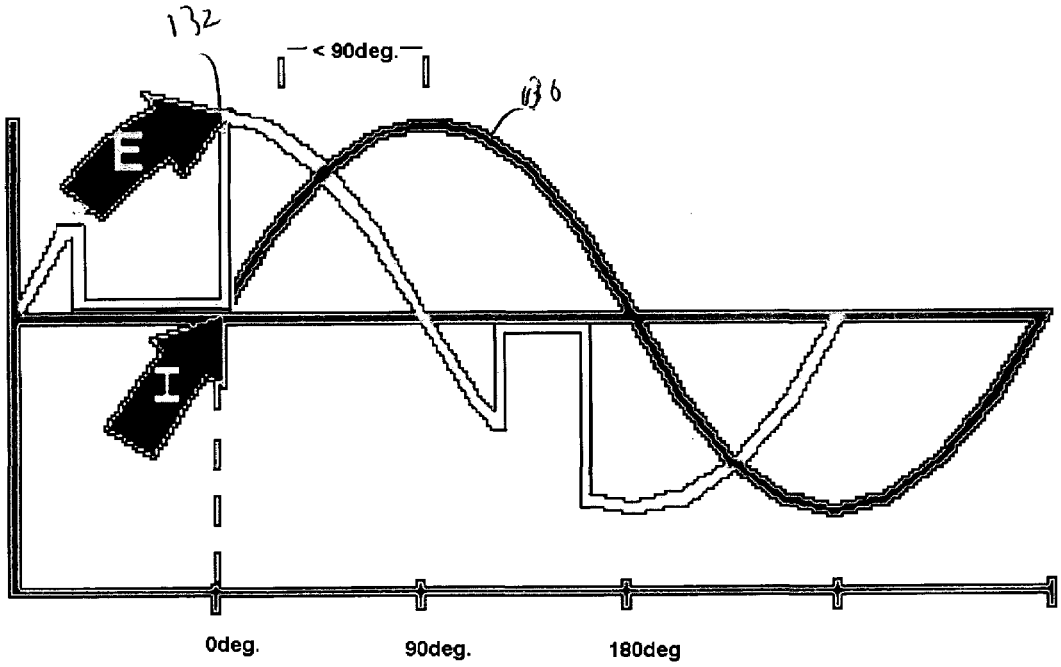
FIG. 4 is a graph of the voltage and current waveforms useful in explaining the operation of the circuits of FIGS. 1 and 2.
Figure 5:
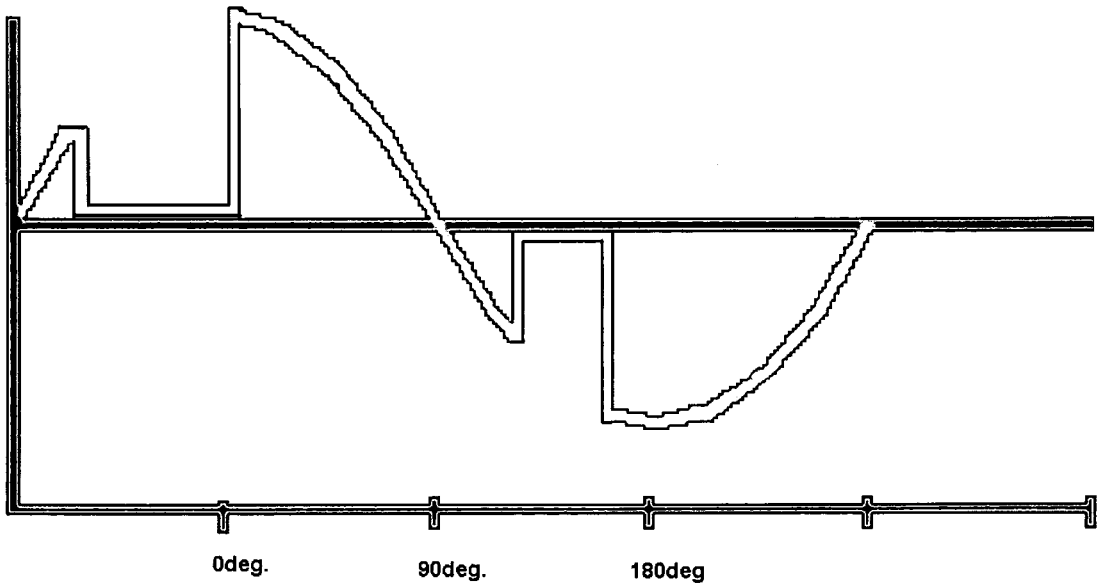
FIG. 5 is a graph of the voltage and current waveform useful in explaining the operation of the circuits of FIGS. 1 and 2.

Once the positive peak or negative peak is determined, the timing of the gate signals is adjusted to chop or remove part of the voltage waveform or to gate the triac into conduction after the start of the voltage waveform so that the voltage applied to the load is adjusted in a manner to reduce the time difference between the positive peak, or negative peak, of the voltage waveform and the current waveform. Thus, as illustrated in FIG. 4, prior to the current wave crossing zero as it transitions to a positive half-cycle of the buffered output of the op amp 70, the triac is switched to chop the voltage signal. This transition occurs for about 15 to 20 degrees. Thus, as illustrated in FIG. 5, the current and voltage waveform, on an average basis, will have a zero differential. The same technique is applied to a negative half-cycle.

However, it will be appreciated that some limit must be placed on the voltage reduction in order to prevent the voltage from being reduced to too low a level in any attempt to phase align the voltage and current waveforms. This is done while adjusting the voltage applied to the load in a manner to bring the power factor towards unity. For this reason, the peak current detection circuit (capacitor 108) provides a peak current representative signal to the processor 84 which acts as a limit and prevents the processor from reducing the voltage applied to the load to a level below that which would maintain peak current above some pre-selected minimum value.

It will be noted that the processor can be programmed to respond to different values of load. For example, if the load comprises a fan and a compressor, the processor can be programmed to detect whether the fan is running by itself, the processor is running by itself, or the fan and compressor are running together by looking at the peak value of the current being drawn. Based upon the peak value of current, the triac can be controlled to regulate to a different value as a function of the particular load which is being powered by the system. In addition, the processor can provide signals indicating the status of the control circuit through use of the light emitting diodes D4, D5, D6 and D7. Each of these light emitting diodes are driven by the processor to indicate various functions such as, for example, whether the system is in a run or non-running mode, or whether gate signals are being applied to the triac. Generation of triac control or gating signals in synchronism with an AC voltage is a process well known in the art. See, for example, U.S. Pat. No. 5,592,062. Accordingly, the software routine implemented in processor 84 is readily developed by a programmer of ordinary skill in the art and detail disclosure of such a program is not necessary. The present invention provides a low cost implementation of a power factor correction circuit using a comparison circuit for obtaining the times of occurrence of a peak value of each of a voltage waveform and a current waveform and utilizes the difference in those times as a measurement of power factor. The act of controlling the applied voltage to adjust power factor is known although the implementation in the present invention presents several cost advantages.

In a preferred embodiment, the MCU will attempt to limit the switching depending on certain characteristics of the load. The characteristics it will attempt to recognize may be, but not limited to, device startup, normal run, and idle. By limiting switching and timing, the MCU in optimal fashion assists in reducing line noise generated by switching. Furthermore, the MCU will be programmed so as to err on the side of caution wherein it will attempt not to damage attached devices by limiting either too much voltage or the voltage over to long of a period. If the load does not meet a designated safety parameter, the MCU will set the triac to operate in a normal condition, not employing the present invention, until such time as the device determines a region in which it can safely switch the load.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. A method of power factor control for a power regulation system connected for supplying electric power to a reactive load, the power factor being characterized by a phase difference between a voltage waveform and an induced current waveform, the method comprising the steps of:

identifying a peak of an AC current waveform and a peak of an AC voltage peak waveform in a corresponding half cycle;

determining a time delay between a peak of a half cycle of the voltage waveform and a peak of the corresponding half cycle of the current waveform; and adjusting the voltage applied to the load in a manner to vary the time delay so as to bring the power factor towards unity.

2. The method of claim 1 and including the step of monitoring peak values of the AC current waveform and limiting a power factor adjustment to prevent respective current values from falling below a selected minimum value.

3. The method of claim 1 wherein the step of adjusting includes the step of removing voltage from the load for a portion of each half-cycle of the AC voltage waveform.

4. The method of claim 2 further comprising monitoring load states and limiting the power factor adjustment based on the load state.

5. The method of claim 1 wherein the step of adjusting further comprises providing a control system with at least one controllable electronic switch coupled in series circuit between an AC power source and the load.

6. The method of claim 1 wherein the step of determining a time delay comprises estimating the time delay.

7. The method of claim 5 wherein the step of adjusting further comprises gating the electronic switch out of conduction for a portion of each half-cycle of the AC voltage waveform.

8. The method of claim 7 wherein the step of gating includes pulse width modulation of the voltage waveform.

9. The method of claim 1 further comprising comparing the peak of the AC voltage waveform to a pre-selected magnitude.

10. The method of claim 1 wherein determining a time delay between a peak of a half cycle of the voltage waveform and a peak of a corresponding half cycle of the current waveform further comprises determining a time delay between a designated peak of a half cycle of the voltage waveform and a designated peak of a corresponding half cycle of the current waveform.

* * * * *